US011489268B2

(12) United States Patent
Onuma et al.

(10) Patent No.: US 11,489,268 B2
(45) Date of Patent: Nov. 1, 2022

(54) ELECTRIC WIRE WITH TERMINAL, COATING APPARATUS, AND METHOD OF MANUFACTURING ELECTRIC WIRE WITH TERMINAL

(71) Applicant: Yazaki Corporation, Tokyo (JP)

(72) Inventors: Masanori Onuma, Shizuoka (JP); Yutaka Matsuoka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/239,528

(22) Filed: Apr. 23, 2021

(65) Prior Publication Data

US 2021/0242609 A1 Aug. 5, 2021

Related U.S. Application Data

(62) Division of application No. 16/852,343, filed on Apr. 17, 2020, now Pat. No. 11,189,940.

(30) Foreign Application Priority Data

May 21, 2019 (JP) ..... JP2019-095019

(51) Int. Cl.
*H01R 4/18* (2006.01)
*H01B 13/32* (2006.01)
*H01R 4/70* (2006.01)

(52) U.S. Cl.
CPC ..... *H01R 4/185* (2013.01); *H01B 13/323* (2013.01); *H01R 4/70* (2013.01)

(58) Field of Classification Search
CPC ..... H01B 13/323; H01R 4/185; H01R 4/70
(Continued)

(56) References Cited

U.S. PATENT DOCUMENTS 6,761,551 B2 7/2004 Kondo
8,622,776 B2 * 1/2014 Morikawa ..... H01R 4/185 439/936

(Continued)

FOREIGN PATENT DOCUMENTS

JP 2012028021 A * 2/2012
JP 2012033378 A * 2/2012

(Continued)

OTHER PUBLICATIONS

Office Action for (parent case) U.S. Appl. No. 16/852,343 dated Jul. 9, 2021.

*Primary Examiner* — Peter G Leigh
(74) *Attorney, Agent, or Firm* — Kenealy Vaidya LLP

(57) ABSTRACT

An electric wire with a terminal includes: an electric wire having a core wire, and a cover; a crimp terminal having a core wire crimping portion which is crimped to the core wire, a cover crimping portion which is crimped to the cover, and a connecting portion which extends from the core crimping portion to the cover crimping portion; and a resin which integrally covers the core wire and the crimp terminal. The core wire has an intermediate portion which extends between the core crimping portion and the cover crimping portion. The connecting portion has a bottom wall portion and a pair of side wall portions which extend in a height direction of the crimp terminal from end portions of the bottom wall portion in a width direction.

2 Claims, 14 Drawing Sheets

(58) Field of Classification Search
USPC ..... 439/877
See application file for complete search history.

(56) References Cited

U.S. PATENT DOCUMENTS

| | | | | |
|---|---|---|---|---|
| 8,927,863 | B2 * | 1/2015 | Tanikawa | H01R 4/70 174/74 A |
| 9,246,239 | B2 | 1/2016 | Inoue et al. | |
| 9,293,838 | B2 | 3/2016 | Sakaguchi | |
| 9,325,085 | B2 * | 4/2016 | Tanaka | H01R 43/28 |
| 9,509,085 | B2 | 11/2016 | Morikawa | |
| 9,543,689 | B2 * | 1/2017 | Sato | H01R 13/5213 |
| 9,570,840 | B2 * | 2/2017 | Morikawa | H01R 4/18 |
| 9,640,879 | B2 | 5/2017 | Tanaka et al. | |
| 9,640,933 | B2 | 5/2017 | Kawamura et al. | |
| 9,647,382 | B2 | 5/2017 | Nabeta | |
| 2010/0035482 | A1 * | 2/2010 | Nakamura | H01R 4/185 439/775 |
| 2013/0098679 | A1 | 4/2013 | Takata et al. | |
| 2013/0252459 | A1 | 9/2013 | Tanaka et al. | |
| 2014/0349501 | A1 | 11/2014 | Aizawa et al. | |
| 2015/0140857 | A1 | 5/2015 | Sato et al. | |
| 2015/0287496 | A1 * | 10/2015 | Sato | H01R 4/70 29/867 |
| 2016/0012943 | A1 | 1/2016 | Rachi et al. | |
| 2018/0375276 | A1 * | 12/2018 | Onuma | H01R 43/005 |
| 2019/0140366 | A1 | 5/2019 | Nomura et al. | |

FOREIGN PATENT DOCUMENTS

| | | | | | |
|---|---|---|---|---|---|
| JP | 2012059595 | A | * | 3/2012 | |
| JP | 2012059671 | A | * | 3/2012 | |
| JP | 2014-203725 | A | | 10/2014 | |
| JP | 2014220097 | A | * | 11/2014 | H01R 4/18 |
| JP | 2015-153716 | A | | 8/2015 | |
| JP | 2015153715 | A | * | 8/2015 | |
| JP | 2015153721 | A | * | 8/2015 | |
| JP | 2016066526 | A | * | 4/2016 | |
| JP | 2016-181387 | A | | 10/2016 | |
| JP | 2018067372 | A | * | 4/2018 | C23F 11/00 |
| JP | 2019009027 | A | * | 1/2019 | H01R 4/18 |
| WO | WO-2011115006 | A1 | * | 9/2011 | H01R 13/03 |
| WO | WO-2012132066 | A1 | * | 10/2012 | H01R 4/70 |
| WO | WO-2013125261 | A1 | * | 8/2013 | B29C 45/14065 |
| WO | WO-2014021278 | A1 | * | 2/2014 | H01R 4/04 |
| WO | WO-2018074153 | A1 | * | 4/2018 | H01R 4/18 |
| WO | WO-2018074192 | A1 | * | 4/2018 | B05C 11/10 |
| WO | WO-2018074232 | A1 | * | 4/2018 | H01R 4/70 |
| WO | WO-2019049437 | A1 | * | 3/2019 | |

* cited by examiner

ELECTRIC WIRE WITH TERMINAL, COATING APPARATUS, AND METHOD OF MANUFACTURING ELECTRIC WIRE WITH TERMINAL

CROSS-REFERENCE TO RELATED APPLICATION(S)

The present application claims priority under 35 U.S.C. § 119 to and incorporates by reference the entire contents of Japanese Patent Application No. 2019-095019 filed in Japan on May 21, 2019 and claims priority under 35. U.S.C. § 120 to U.S. application Ser. No. 16/852,343 filed on Apr. 17, 2020.

BACKGROUND OF THE INVENTION

1. Field of the Invention

The present invention relates to an electric wire with a terminal, a coating apparatus, and a method of manufacturing an electric wire with a terminal.

2. Description of the Related Art

Conventionally, there has been known a technique which applies a resin by coating to an electric wire with a terminal. Japanese Patent Application Laid-open No. 2016-181387 discloses an electric wire with a terminal which includes a covered electric wire, a conductive crimped portion, a terminal having a cover crimping portion, and ultraviolet-curable resin member which covers a conductor exposed from an insulating cover.

With respect to an electric wire with a terminal, it is desirable that a connecting portion extending from a core crimping portion to the cover crimping portion be properly covered by a resin. The connecting portion has a bottom wall portion, and side wall portions extending from the bottom wall portion along a height direction. Distal end surfaces of the side wall portions are cut surfaces formed at the time of manufacturing a crimp terminal. When the distal end surfaces of the side wall portions are exposed, there is a concern that corrosion prevention performance of the electric wire with a terminal is lowered. On the other hand, when outer side surfaces of the side wall portions are also coated with a resin, a terminal width of the crimp terminal is increased.

SUMMARY OF THE INVENTION

Accordingly, it is an object of the present invention to provide an electric wire with a terminal, a coating apparatus, and a method of manufacturing an electric wire with a terminal which can acquire both the reduction of a terminal width and enhancement of corrosion prevention performance.

An electric wire with a terminal according to one aspect of the present invention includes an electric wire having a core wire, and a cover that covers the core wire in a state where an end portion of the core wire is exposed; a crimp terminal having a core crimping portion that is crimped to the core wire, a cover crimping portion that is crimped to the cover, and a connecting portion that extends from the core crimping portion to the cover crimping portion; and a resin which integrally covers the core wire and the crimp terminal, wherein the core wire has an intermediate portion which extends between the core crimping portion and the cover crimping portion, the connecting portion has a bottom wall portion, and a pair of side wall portions which extend in a height direction of the crimp terminal from end portions of the bottom wall portion in a width direction, the resin has a first cover portion which integrally covers distal end surfaces of the side wall portions and the intermediate portion, and the first cover portion has side surfaces which are continuously formed with outer side surfaces of the side wall portions and extend in the height direction on both sides in the width direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an electric wire with a terminal, a coating apparatus, and a method of manufacturing an electric wire with a terminal according to an embodiment of the present invention are described in detail with reference to drawings. The present invention is not limited by the embodiment. Further, constitutional elements in the embodiment described hereinafter include constitutional elements which a person skilled in the art can easily conceive or parts substantially equal to the constitutional elements.

Embodiment

Figure 1:
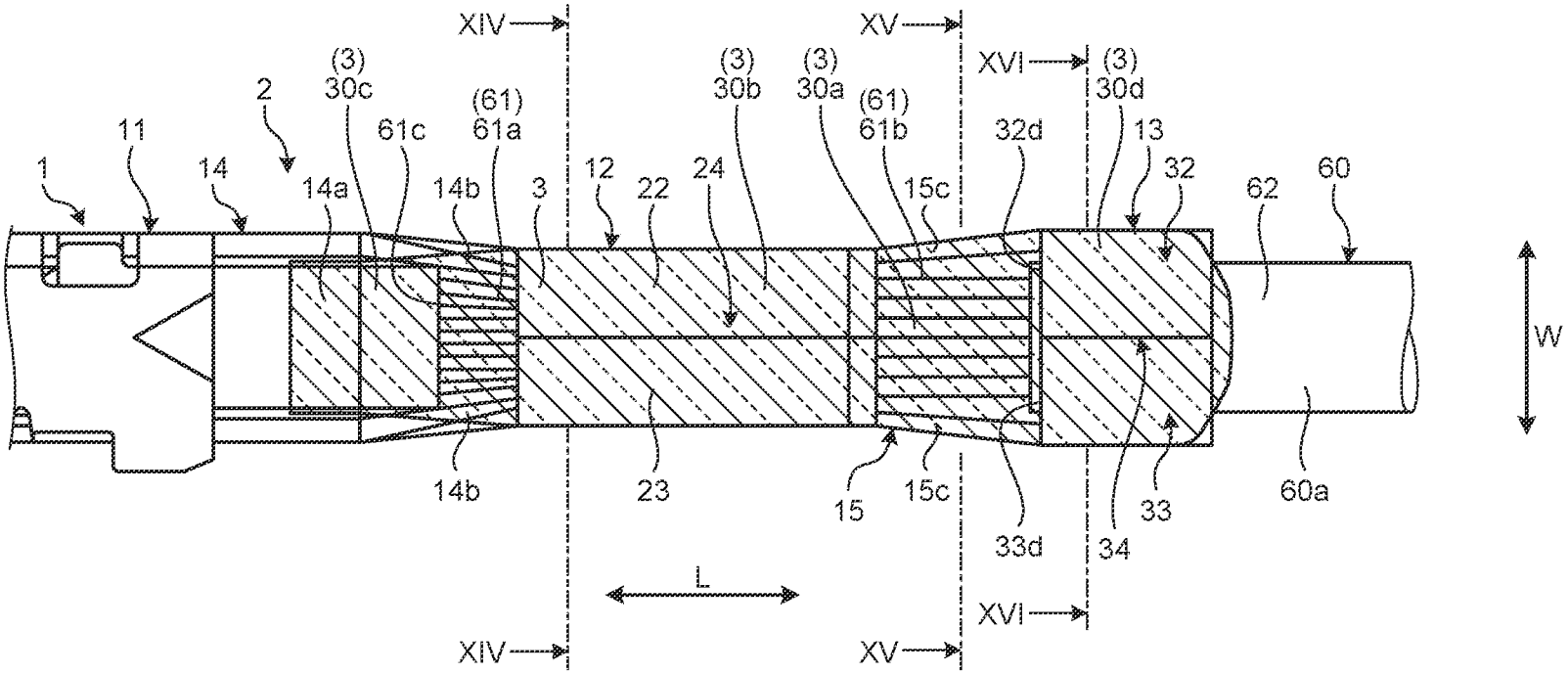
FIG. 1 is a plan view of an electric wire with a terminal according to an embodiment.
Figure 5:
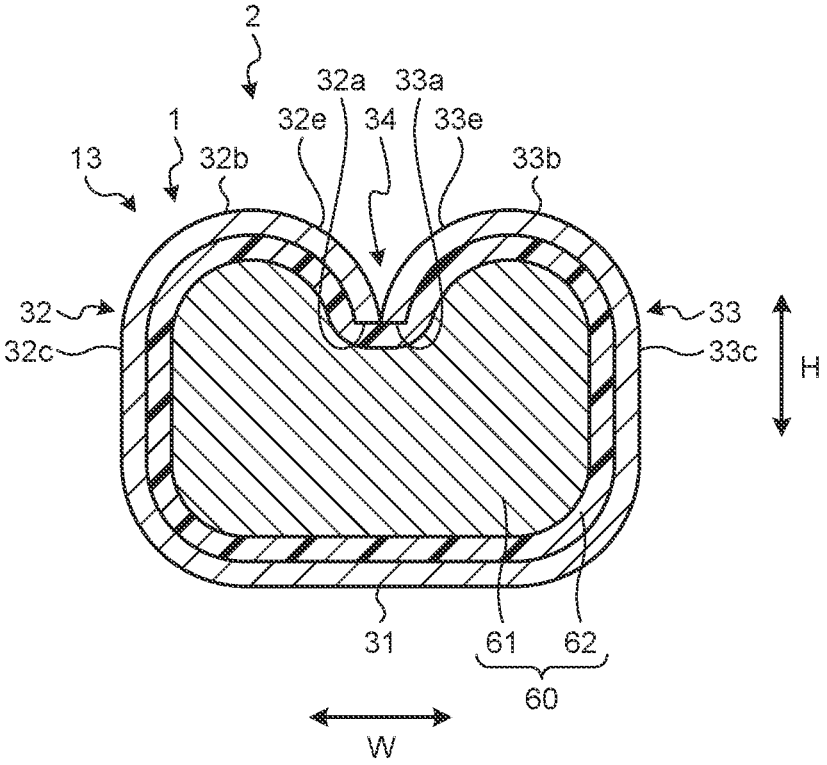
FIG. 5 is a cross-sectional view of a cover crimping portion before the resin is applied by coating.
Figure 6:
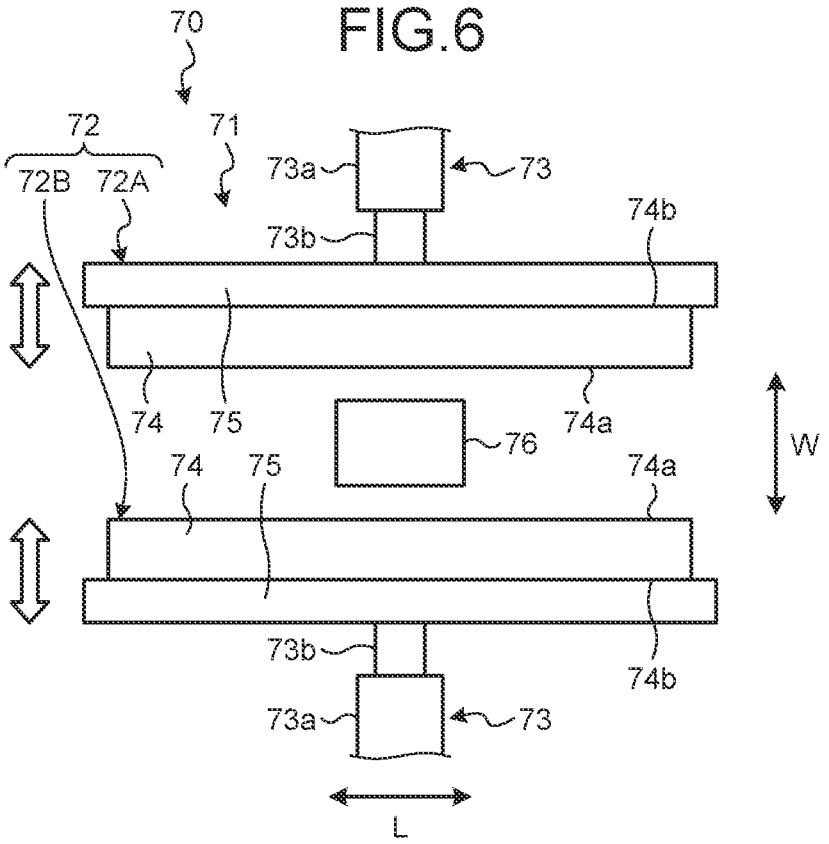
FIG. 6 is a schematic configurational view of a coating apparatus according to the embodiment.
Figure 7:
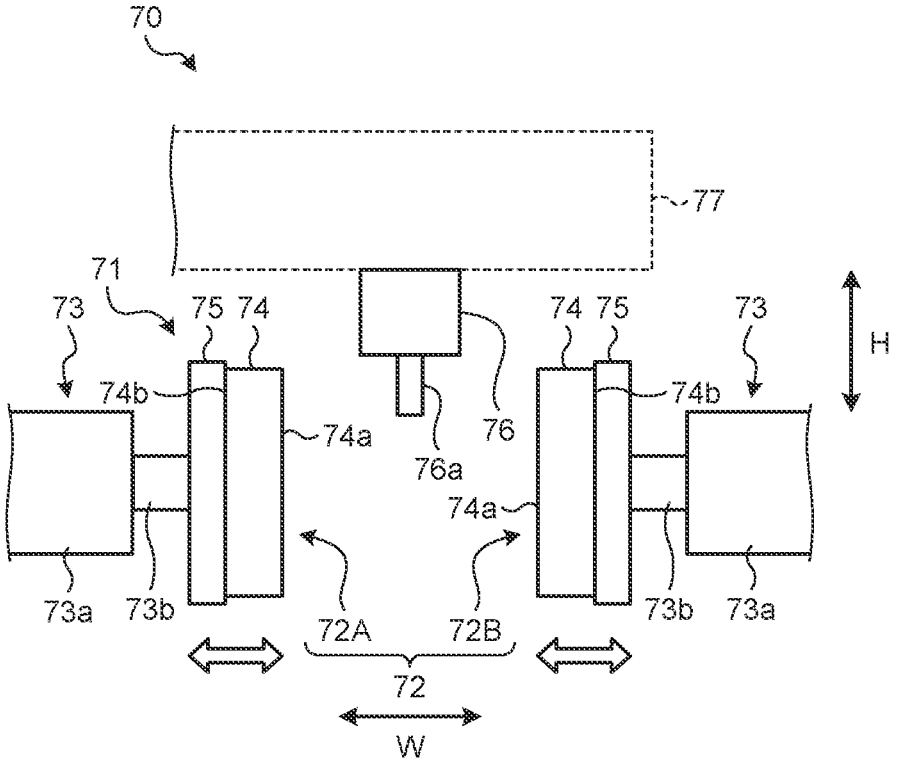
FIG. 7 is a side view of the coating apparatus according to the embodiment.
Figure 8:
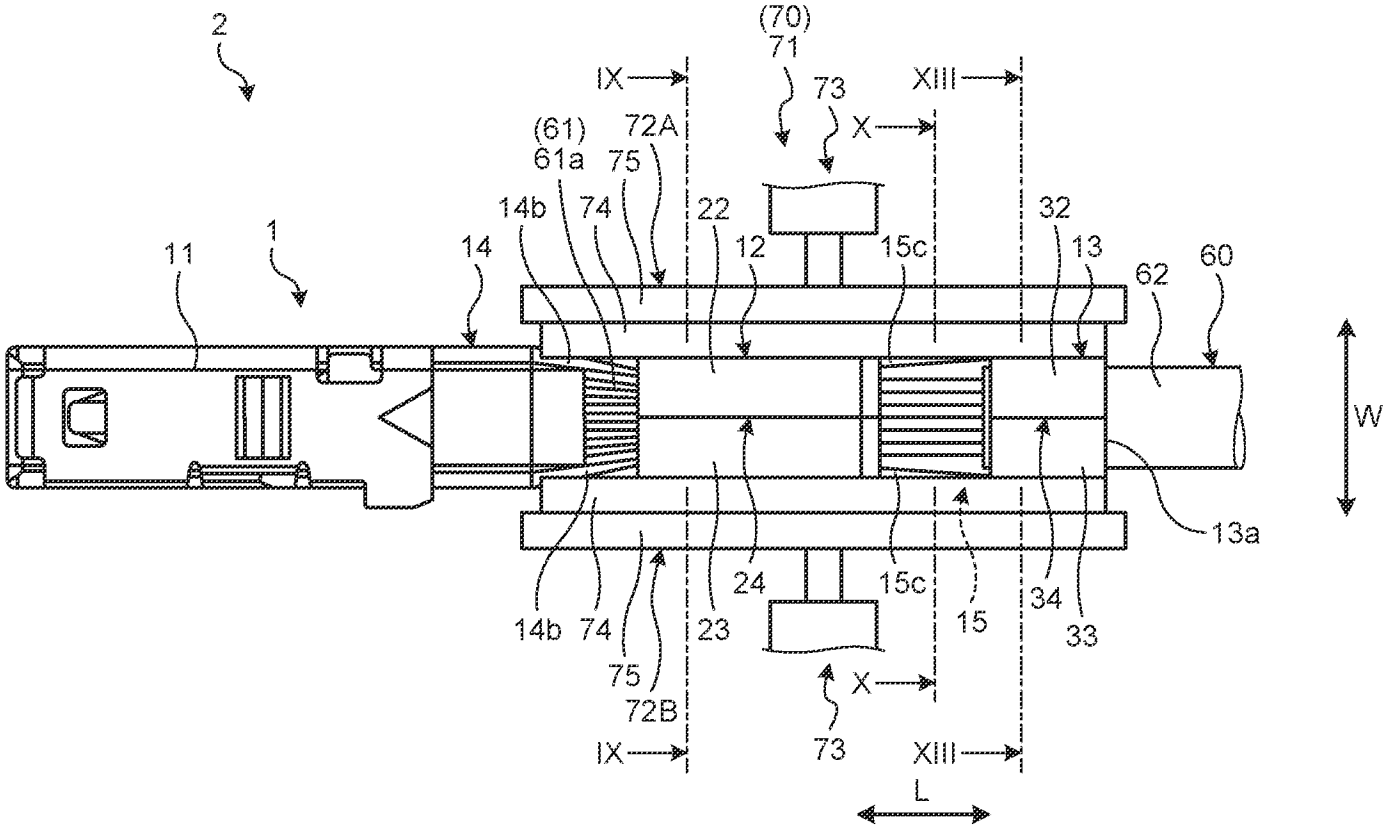
FIG. 8 is a plan view describing a holding step of the embodiment.
Figure 9:
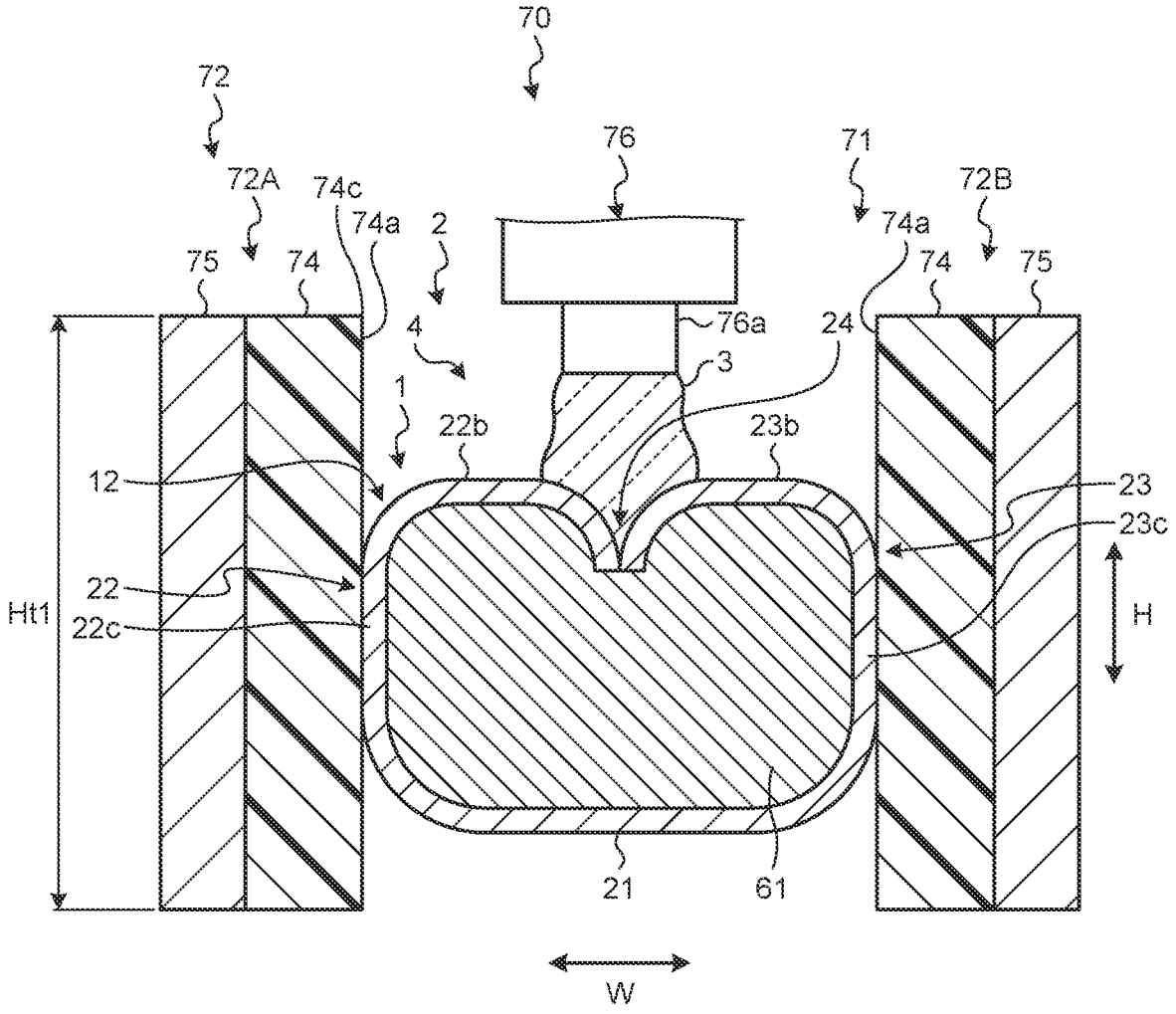
FIG. 9 is a cross-sectional view describing a coating step of the embodiment.
Figure 10:
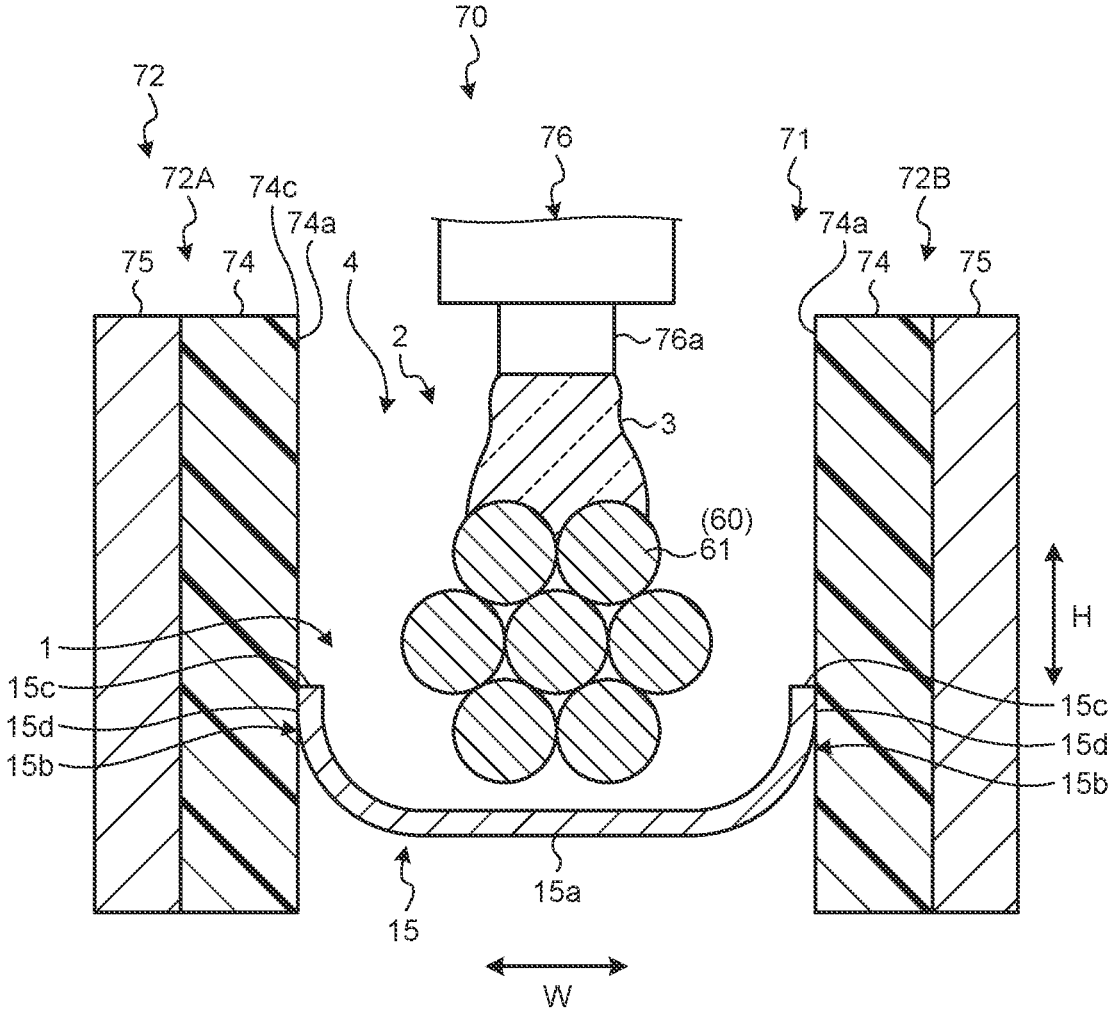
FIG. 10 is another cross-sectional view describing a coating step of the embodiment.

An embodiment is described with reference to FIGS. 1 to 16. This embodiment relates to an electric wire with a terminal, a coating apparatus, and a method of manufacturing an electric wire with a terminal. FIG. 1 is a plan view of an electric wire with a terminal according to an embodiment, FIG. 2 is a plan view of the electric wire with a terminal before a resin is applied by coating, FIG. 3 is a cross-sectional view of a core crimping portion before the resin is applied by coating, FIG. 4 is a cross-sectional view of a connecting portion before the resin is applied by coating, FIG. 5 is a cross-sectional view of a cover crimping portion before the resin is applied by coating, FIG. 6 is a schematic configurational view of a coating apparatus according to the embodiment, FIG. 7 is a side view of the coating apparatus according to the embodiment, FIG. 8 is a plan view describing a holding step of the embodiment, FIG. 9 is a cross-sectional view describing a coating step of the embodiment, and FIG. 10 is another cross-sectional view describing a coating step of the embodiment.

Figure 11:
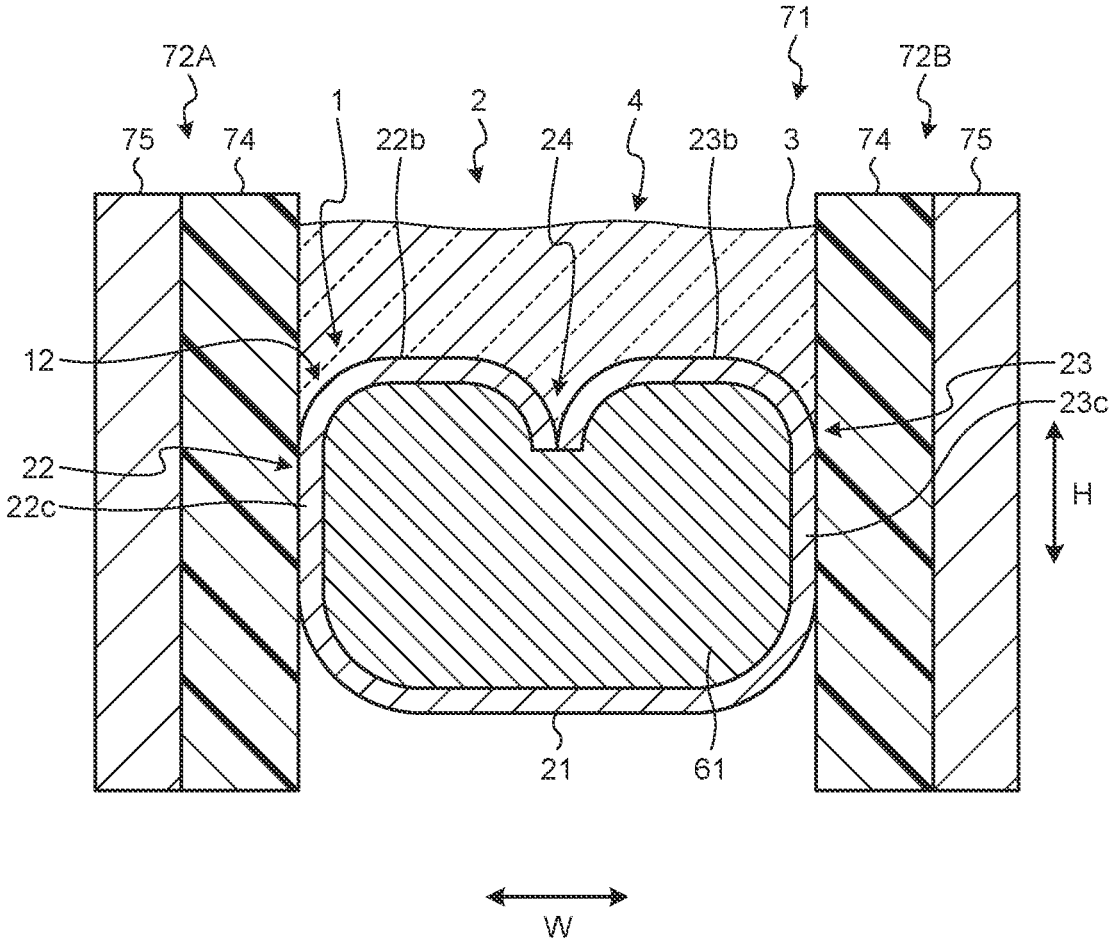
FIG. 11 is a cross-sectional view describing the resin applied to the core crimping portion by coating.
Figure 12:
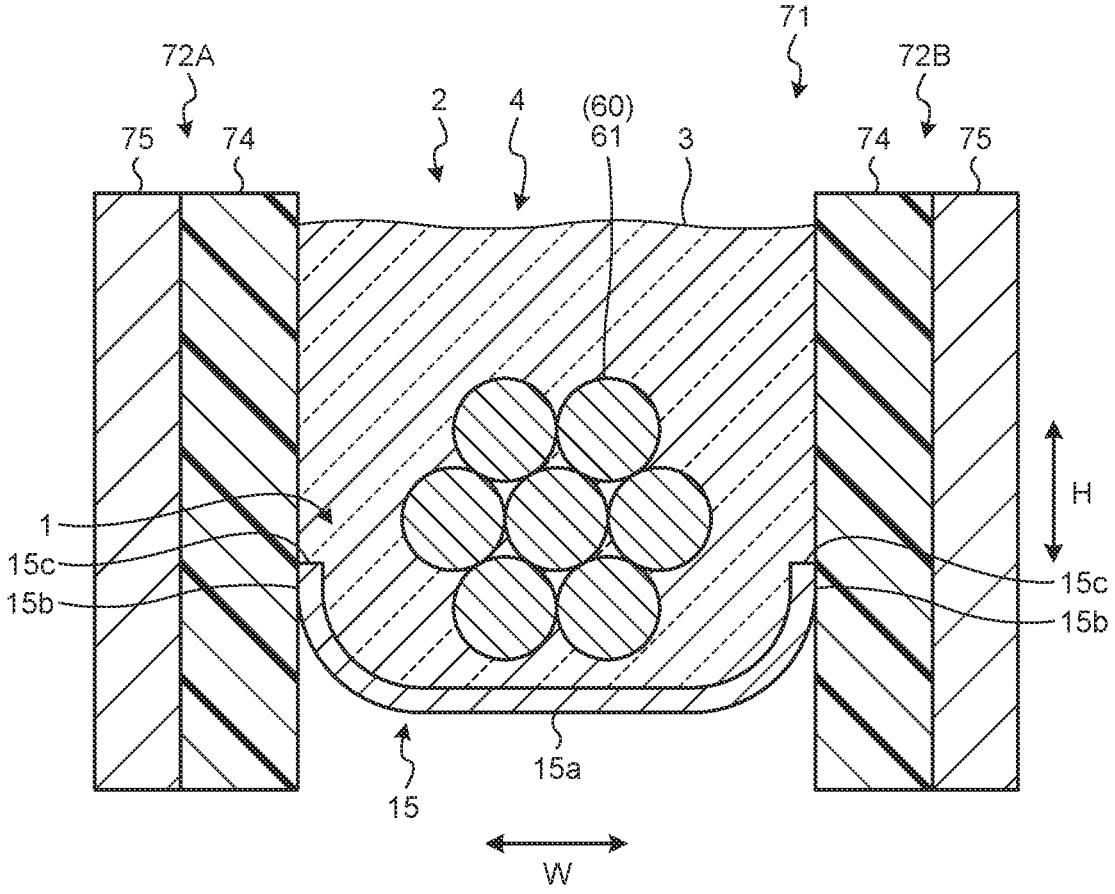
FIG. 12 is a cross-sectional view describing the resin applied to the connecting portion by coating.
Figure 13:
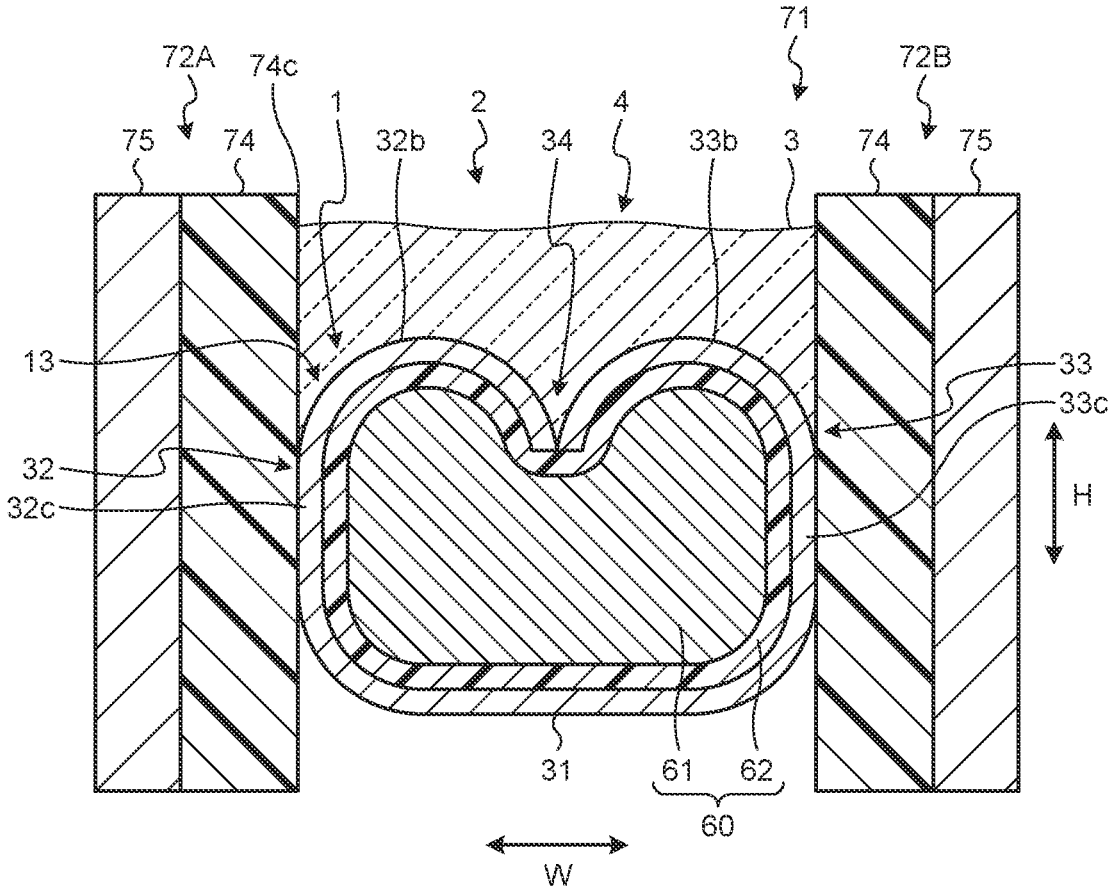
FIG. 13 is a cross-sectional view describing the resin applied to the cover crimping portion by coating.
Figure 14:
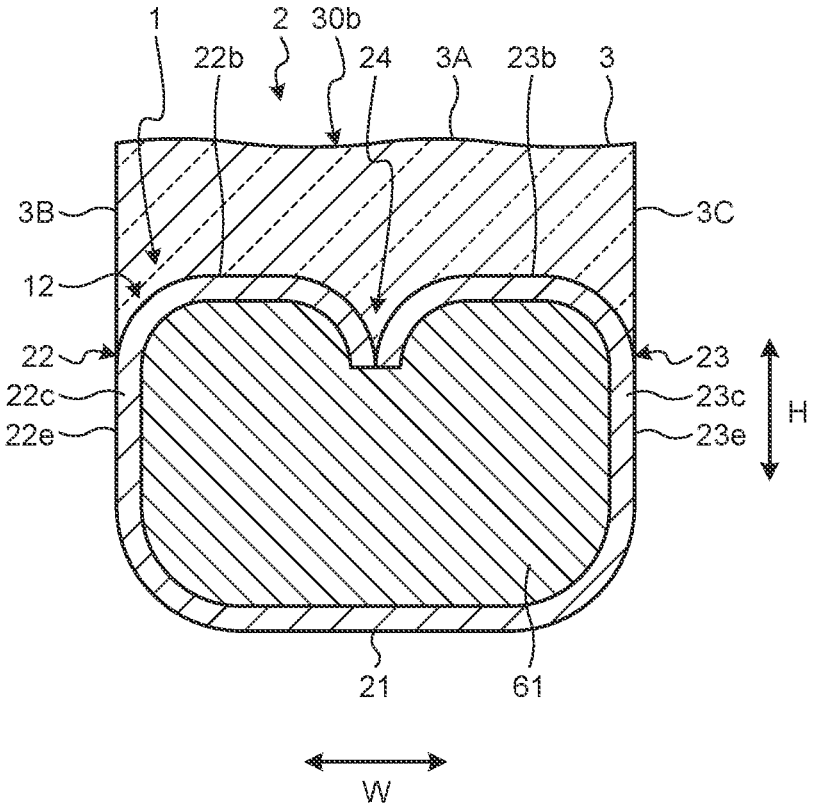
FIG. 14 is a cross-sectional view of the core crimping portion of the electric wire with a terminal according to the embodiment.
Figure 15:
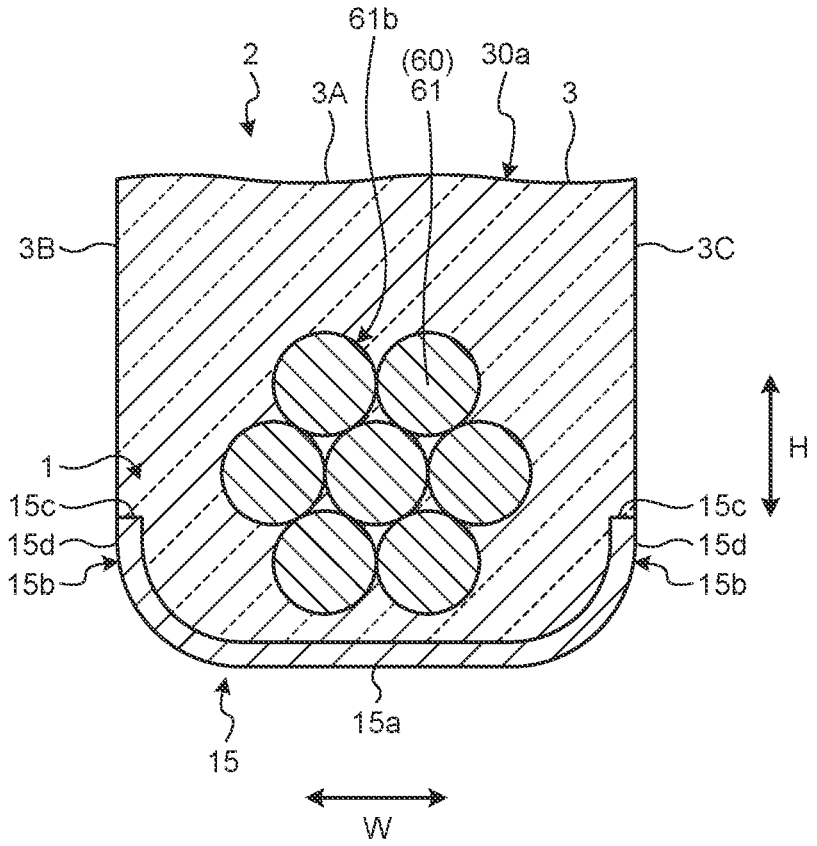
FIG. 15 is a cross-sectional view of the connecting portion of the electric wire with a terminal according to the embodiment.
Figure 16:
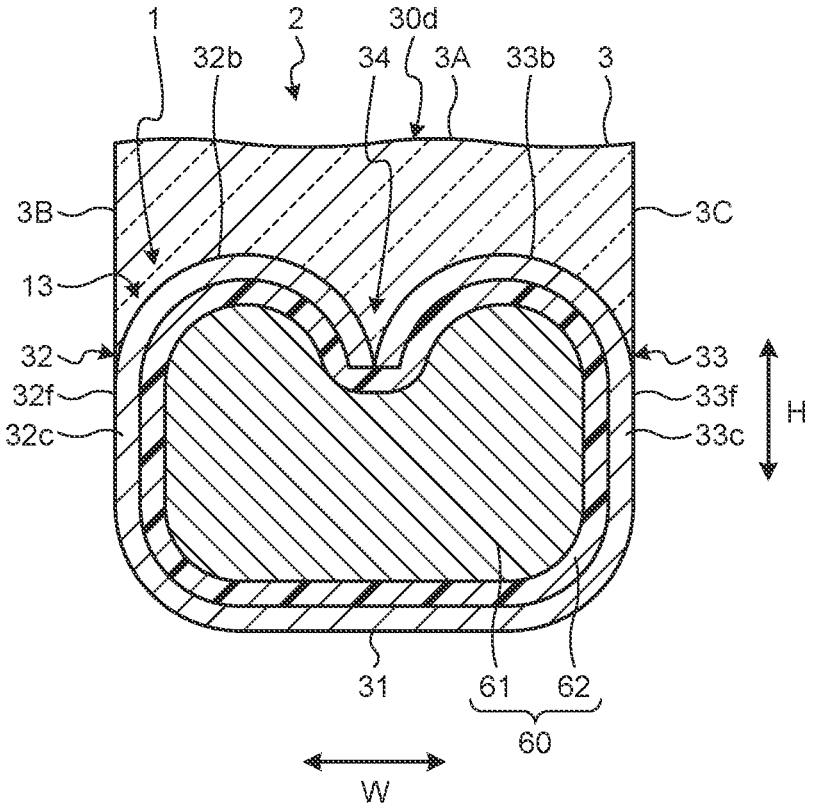
FIG. 16 is a cross-sectional view of the cover crimping portion of the electric wire with a terminal according to the embodiment.

FIG. 11 is a cross-sectional view describing the resin applied to the core crimping portion by coating, FIG. 12 is a cross-sectional view describing the resin applied to the connecting portion by coating, FIG. 13 is a cross-sectional view describing the resin applied to the cover crimping portion by coating, FIG. 14 is a cross-sectional view of the core crimping portion of the electric wire with a terminal according to the embodiment, FIG. 15 is a cross-sectional view of the connecting portion of the electric wire with a terminal according to the embodiment, and FIG. 16 is a cross-sectional view of the cover crimping portion of the electric wire with a terminal according to the embodiment.

Figure 2:
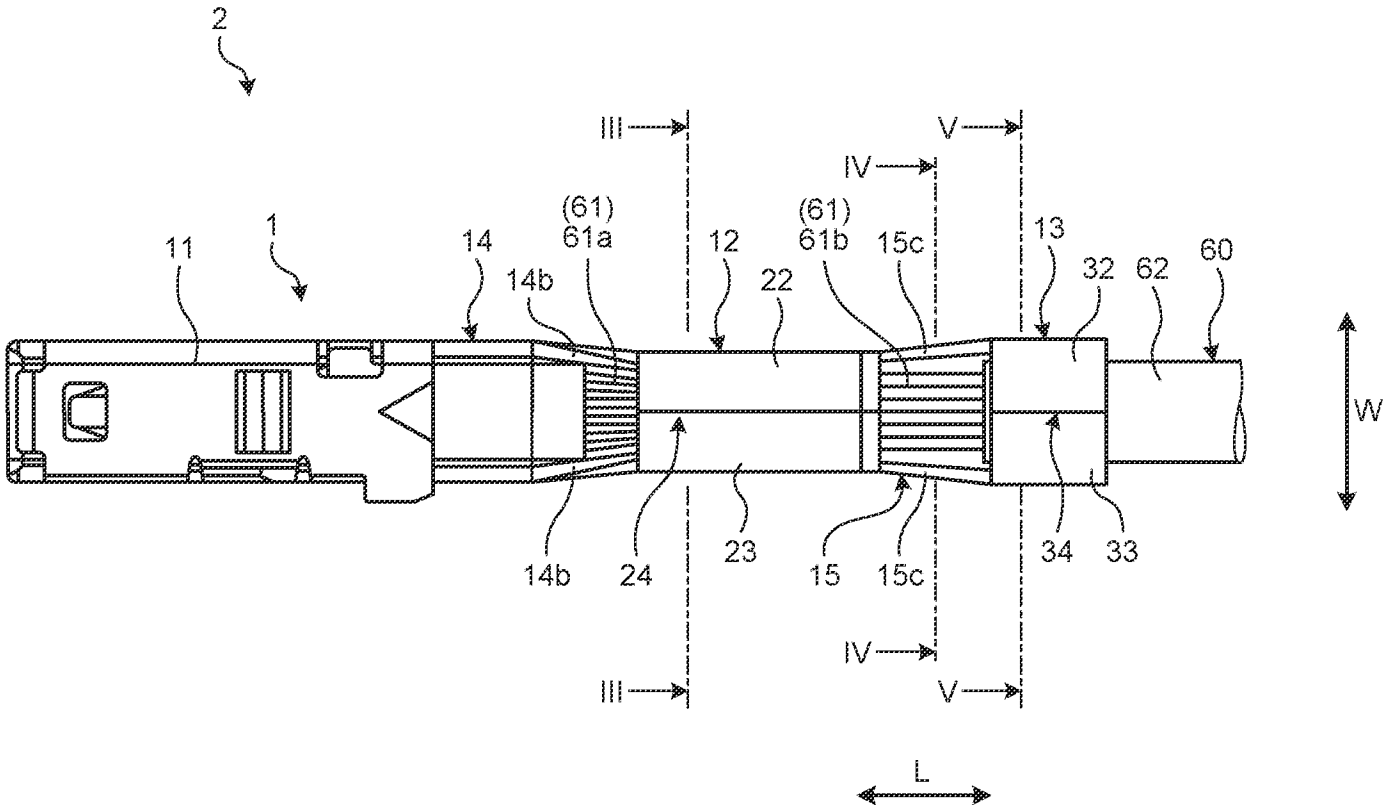
FIG. 2 is a plan view of the electric wire with a terminal before a resin is applied by coating.
Figure 3:
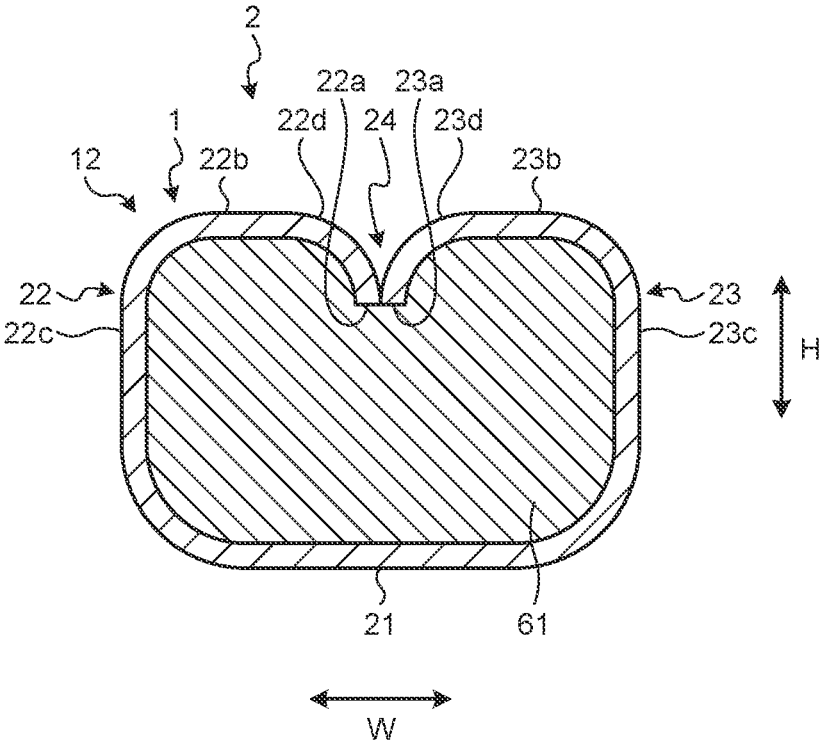
FIG. 3 is a cross-sectional view of a core crimping portion before the resin is applied by coating.
Figure 4:
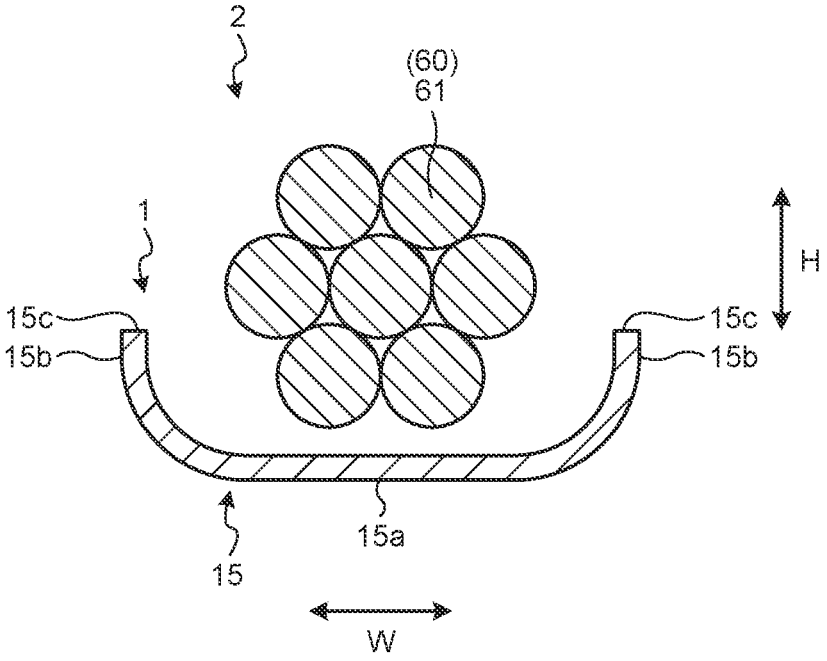
FIG. 4 is a cross-sectional view of a connecting portion before the resin is applied by coating.

FIG. 3 illustrates a cross section taken along line III-III in FIG. 2 FIG. 4 illustrates a cross section taken along line IV-IV in FIG. 2. FIG. 5 illustrates a cross section taken along line V-V in FIG. 2. FIG. 9 and FIG. 11 illustrate a cross section taken along line IX-IX in FIG. 8. FIG. 10 and FIG. 12 illustrate a cross section taken along line X-X in FIG. 8. FIG. 13 illustrates a cross section taken along line XIII-XIII in FIG. 8. FIG. 14 illustrates a cross section taken along line XIV-XIV in FIG. 1. FIG. 15 illustrates a cross section taken along line XV-XV in FIG. 1. FIG. 16 illustrates a cross section taken along line XVI-XVI in FIG. 1.

As illustrated in FIG. 1, an electric wire with a terminal 2 according to the embodiment includes an electric wire 60, a crimp terminal 1, and a resin 3. The electric wire 60 has a core wire 61 and a cover 62 having insulating property which covers the core wire 61. The core wire 61 is formed using copper or aluminum as a material, for example. The cover 62 disposed at an end portion of the electric wire 60 is removed so that the core wire 61 is exposed by a predetermined length. In this embodiment, the core wire 61 is an assembled body of a plurality of strands. However, the core wire 61 may be formed of a single line such as a coaxial electric wire. The crimp terminal 1 is electrically connected to the exposed core wire 61 by being crimped to the end portion of the electric wire 60.

The crimp terminal 1 includes a terminal connecting portion 11, a core crimping portion 12, a connecting portion 15, and a cover crimping portion 13. The terminal connecting portion 11, the core crimping portion 12, the connecting portion 15, and the cover crimping portion 13 are arranged along a longitudinal direction of the crimp terminal 1 in this order. The crimp terminal 1 is formed using a conductive metal plate (for example, a copper plate, a copper alloy plate) as a base material. The crimp terminal 1 is formed into a predetermined shape by blanking or bending the base material. Plating made of tin (Sn) or the like may be formed on a surface of the base material.

In this specification, in describing the crimp terminal 1, a connecting direction with a counterpart terminal, that is, an inserting direction of the crimp terminal 1 into the counterpart terminal is referred to as a first direction L. The first direction L is the longitudinal direction of the crimp terminal 1. A width direction of the crimp terminal 1 is referred to as a second direction W. The second direction W is orthogonal to the first direction L. In the crimp terminal 1, a direction which is orthogonal to both the first direction L and the second direction W is referred to as a third direction H. The third direction H is a compression direction when the crimp terminal 1 is crimped. The third direction H is a height direction of the crimp terminal 1.

The terminal connecting portion 11 is a portion which is electrically connected with the counterpart terminal. In this embodiment, the terminal connecting portion 11 has an angular sleeve shape. The core crimping portion 12 is crimped to the core wire 61 of the electric wire 60. The cover crimping portion 13 is crimped to the cover 62 of the electric wire 60. The connecting portion 15 extends along the first direction L, and connects the core crimping portion 12 and the cover crimping portion 13 to each other. The terminal connecting portion 11 and the core crimping portion 12 are connected to each other by way of an intermediate portion 14.

In the method of manufacturing the electric wire with a terminal 2 according to this embodiment, firstly, as illustrated in FIG. 2, the crimp terminal 1 is crimped to the electric wire 60. In a crimping step where the crimp terminal 1 is crimped to the electric wire 60, a terminal crimping device having a crimper and an anvil is used. The terminal crimping device caulks the core crimping portion 12 to the core wire 61, and caulks the cover crimping portion 13 to the cover 62. A distal end 61*a* of the core wire 61 protrudes from the core crimping portion 12 toward the terminal connecting portion 11. Further, an intermediate portion 61*b* which forms a part of the core wire 61 is exposed to an outer space between the core crimping portion 12 and the cover crimping portion 13. The intermediate portion 61*b* is a portion which is positioned inside the connecting portion 15.

As illustrated in FIG. 3, the core crimping portion 12 is crimped to the core wire 61 in an approximately B shape. The core crimping portion 12 has a bottom wall portion 21, a first caulking lug 22, and a second caulking lug 23. The bottom wall portion 21 is a portion which forms a bottom wall of the core crimping portion 12. The first caulking lug 22 and the second caulking lug 23 form a pair of conductive caulking lugs caulked to the core wire 61. The first caulking lug 22 is a side wall portion which extends along the third direction H from one end of the bottom wall portion 21 in a width direction. The second caulking lug 23 is a side wall portion which extends along the third direction H from the other end of the bottom wall portion 21 in a width direction.

Cross-sectional shapes of the first caulking lug 22 and the second caulking lug 23 after caulking are curved shapes protruding toward a side opposite to a bottom wall portion 21 side respectively. More specifically, the first caulking lug 22 has a curved portion 22*b* and a proximal end portion 22*c*. The proximal end portion 22*c* is a portion which extends from the bottom wall portion 21 along the third direction H in a straight line shape. The curved portion 22*b* is a portion disposed on a distal end side compared to the proximal end portion 22*c* of the first caulking lug 22, and is curved toward an outer side. The first caulking lug 22 and the second caulking lug 23 are wrapped around the core wire 61 in a state where distal end surfaces 22*a*, 23*a* opposedly face the bottom wall portion 21. A groove portion 24 is formed at a portion where an outer side surface 22*d* of the first caulking lug 22 and an outer side surface 23*d* of the second caulking lug 23 are brought into contact with each other. The groove portion 24 extends along the first direction L.

As illustrated in FIG. 5, the cover crimping portion 13 is crimped to the cover 62 in an approximately B shape. The cover crimping portion 13 has a bottom wall portion 31, a first caulking lug 32, and a second caulking lug 33. The bottom wall portion 31 is a portion which forms a bottom wall of the cover crimping portion 13. The first caulking lug 32 and the second caulking lug 33 form a pair of cover caulking lugs caulked to the cover 62. The first caulking lug 32 is a side wall portion which extends along the third direction H from one end of the bottom wall portion 31 in a width direction. The second caulking lug 33 is a side wall portion which extends along the third direction H from the other end of the bottom wall portion 31 in a width direction.

Shapes of the first caulking lug 32 and the second caulking lug 33 after caulking are curved shapes protruding toward a side opposite to a bottom wall portion 31 side respectively. More specifically, the first caulking lug 32 has a curved portion 32*b* and a proximal end portion 32*c*. The proximal end portion 32*c* is a portion which extends from the bottom wall portion 31 along the third direction H in a straight line shape. The curved portion 32*b* is a portion disposed on a distal end side compared to the proximal end portion 32*c* of the first caulking lug 32. The curved portion 32*b* is curved toward the outside.

The second caulking lug 33 has a curved portion 33*b* and a proximal end portion 33*c*. The proximal end portion 33*c* is a portion which extends from the bottom wall portion 31 along the third direction H in a straight line shape. The curved portion 33*b* is a portion disposed on a distal end side compared to a proximal end portion 33*c* of the second caulking lug 33, and is curved toward an outer side. The first caulking lug 32 and the second caulking lug 33 are wrapped around the cover 62 in a state where the distal end surfaces 32*a*, 33*a* opposedly face the bottom wall portion 31. A groove portion 34 is formed at a portion where an outer side surface 32*e* of the first caulking lug 32 and an outer side surface 33*e* of the second caulking lug 33 are brought into contact with each other. The groove portion 34 extends along the first direction L.

As illustrated in FIG. 4, the connecting portion 15 has a substantially U-shaped cross-sectional shape. The connecting portion 15 has a bottom wall portion 15*a* and a pair of side wall portions 15*b*. The bottom wall portion 15*a* is a portion which forms a bottom wall of the connecting portion 15. The bottom wall portion 15*a* connects the bottom wall portion 21 of the core crimping portion 12 and the bottom wall portion 31 of the cover crimping portion 13.

One of the pair of side wall portions 15*b* extends in the third direction H from one end of the bottom wall portion 15*a* in the width direction. The other of the pair of side wall portions 15*b* extends along the third direction H from the other end of the bottom wall portion 15*a* in the width direction. The side wall portions 15*b* are, for example, orthogonal to the second direction W. One of the pair of side wall portions 15*b* connects the proximal end portion 22*c* of the first caulking lug 22 and the proximal end portion 32*c* of the first caulking lug 32 to each other. The other of the pair of side wall portions 15*b* connects a proximal end portion 23*c* of the second caulking lug 23 and a proximal end portion 33*c* of the second caulking lug 33 to each other. Distal end surfaces 15*c* of the side wall portions 15*b* are directed toward a side opposite to the bottom wall portion 15*a*. The distal end surfaces 15*c* are, for example, orthogonal to the third direction H.

Coating of a resin 3 to the electric wire with a terminal 2 is performed using a coating apparatus 70 illustrated in FIGS. 6 and 7. The resin 3 to be coated in this embodiment is an ultraviolet curable resin. As the resin 3, for example, a thermosetting resin or a two-component curable resin may be used.

The coating apparatus 70 according to this embodiment includes a holding unit 71 and a coating unit 76. The holding unit 71 functions as a chuck for holding the electric wire with a terminal 2. The holding unit 71 has a pair of pressing portions 72 and a pair of driving units 73. The pair of pressing portions 72 have a first pressing portion 72A and a second pressing portion 72B. The first pressing portion 72A and the second pressing portion 72B each have an elastic member 74 and a rigid member 75.

The elastic member 74 is a member formed in a plate shape. The elastic member 74 of this embodiment is formed in a flat plate shape having a rectangular planar shape. The elastic member 74 has a holding surface 74*a* for holding the electric wire with a terminal 2. The holding surface 74*a* is, for example, a flat surface. The holding surface 74*a* of the first pressing portion 72A and the holding surface 74*a* of the second pressing portion 72B opposedly face each other. The elastic member 74 is formed using a material that elastically deforms in conformity with the shape of the crimp terminal 1. The elastic member 74 is also formed using a material which is easily removable from the cured resin 3. That is, in this embodiment, the elastic member 74 is formed of a repulsive member having good removal property from the resin 3. Against an ultraviolet curable resin, for example, silicone rubber or fluorine rubber is used as a material for forming the elastic member 74.

The rigid member 75 is a member formed in a plate shape, and supports the elastic member 74. The rigid member 75 of this embodiment is formed in a flat plate shape having a rectangular planar shape. The rigid member 75 has higher rigidity than the elastic member 74, and is a metal plate, for example. The rigid member 75 is fixed to a back surface 74*b* of the elastic member 74. The back surface 74*b* is a surface of the elastic member 74 on a side opposite to the holding surface 74*a*.

The driving units 73 are disposed on the first pressing portion 72A and the second pressing portion 72B respectively. The driving units 73 are mechanisms which drive the pair of pressing portions 72. The driving unit 73 of this embodiment is an air cylinder. The driving unit 73 has a cylinder 73*a* and a rod 73*b*. The cylinders 73*a* and the rods 73*b* extend in the second direction W, in other words, along the direction in which two holding surfaces 74*a* face each other. A distal end of the rod 73*b* is connected to a back surface of the rigid member 75. The driving units 73 move the first pressing portion 72A and the second pressing portion 72B in the second direction W by advancing or retracting the rods 73*b* along the second direction W.

The coating unit 76 is a mechanism for ejecting the resin 3 in a liquid form to the electric wire with a terminal 2. As illustrated in FIG. 7, the coating unit 76 of this embodiment has a nozzle 76*a*. The coating apparatus 70 has a pressure feeding mechanism 77 which pressure-feeds the resin 3 toward the coating unit 76. The pressure feeding mechanism 77 has a function of adjusting a flow rate and a pressure of the resin 3.

A method of manufacturing an electric wire with a terminal according to this embodiment will be described. The method of manufacturing an electric wire with a terminal includes a holding step and a coating step. The holding step is a step of holding the electric wire with a terminal 2 by the holding unit 71. As illustrated in FIG. 8, the holding unit 71 presses and holds the crimp terminal 1 from both sides in the width direction by the first pressing portion 72A and the second pressing portion 72B. The driving units 73 press the elastic members 74 to the crimp terminal 1. The magnitude of a pressing force for pressing the first pressing portion 72A and the second pressing portion 72B toward the crimp terminal 1 is set such that the elastic members 74 can be brought into close contact with the side surface of the crimp terminal 1. Accordingly, the elastic members 74 are elastically deformed in conformity with the shape of the crimp terminal 1 and hold the crimp terminal 1 in a state where a gap is not formed between the elastic members 74 and the crimp terminal 1.

In the holding unit 71 of this embodiment, the intermediate portion 14, the core crimping portion 12, the connecting portion 15, and the cover crimping portion 13 are sandwiched between two elastic members 74. The elastic members 74 hold the crimp terminal 1 within a range from the intermediate portion 14 to the end surface 13*a* of the cover crimping portion 13. As illustrated in FIGS. 9 and 10, a height Ht1 of the elastic member 74 is greater than a height of the crimp terminal 1. The holding unit 71 holds the crimp terminal 1 such that upper portions of the holding surfaces 74*a* protrude above the crimp terminal 1.

Two elastic members 74 sandwich the crimp terminal 1 and form the storage portion 4 for storing the resin 3. The storage portion 4 is a space surrounded by two holding surfaces 74*a* and the crimp terminal 1. For example, as illustrated in FIG. 9, in the core crimping portion 12, the storage portion 4 is formed by two holding surfaces 74*a*, the curved portion 22*b* of the first caulking lug 22, and the curved portion 23*b* of the second caulking lug 23. The holding unit 71 holds the crimp terminal 1 such that the core crimping portion 12 is positioned below the upper end 74*c* of the holding surfaces 74*a*. Similarly, the holding unit 71 holds the crimp terminal 1 so that the cover crimping portion 13 is positioned below the upper ends 74*c* of the holding surfaces 74*a* (see FIG. 13).

As illustrated in FIG. 10, in the connecting portion 15, the storage portion 4 is formed by two holding surfaces 74*a* and the connecting portion 15. The holding unit 71 holds the crimp terminal 1 such that the core wire 61 is positioned below the upper ends 74*c* of the holding surfaces 74*a*. The holding surfaces 74*a* are brought into close contact with the outer side surfaces 15*d* of the side wall portions 15*b*, and hold the outer side surface 15*d*.

The coating step is a step of applying the resin 3 to the electric wire with a terminal 2. The coating apparatus 70 applies the resin 3 to the electric wire with a terminal 2 held by a pair of pressing portions 72. As illustrated in FIGS. 9 and 10, the coating unit 76 continuously ejects the resin 3 from the nozzle 76*a*. The coating apparatus 70 applies the resin 3 by coating from the nozzle 76*a* while moving the nozzle 76*a* and the electric wire with a terminal 2 relative to each other. The coating apparatus 70 may move the nozzle 76*a* or may move the holding unit 71.

As illustrated in FIG. 9, when the nozzle 76*a* opposedly faces the core crimping portion 12, the resin 3 ejected from the nozzle 76*a* is applied by coating to the core crimping portion 12. The coating unit 76 ejects the resin 3 toward the groove portion 24, for example. The ejected resin 3 is stored in the storage portion 4 while spreading from the groove portion 24 to the entire core crimping portion 12. As a result, as illustrated in FIG. 11, a layer of the resin 3 which entirely covers an upper surface of the core crimping portion 12 is formed. The resin 3 covers the upper surface of the core crimping portion 12 from one end to the other end in the second direction W.

As illustrated in FIG. 10, when the nozzle 76*a* opposedly faces the connecting portion 15, the resin 3 ejected from the nozzle 76*a* is applied by coating to the core wire 61 and the connecting portion 15. The coating unit 76 ejects the resin 3 toward the core wire 61, for example. The ejected resin 3 is stored in the storage portion 4 while spreading over the entire connecting portion 15. As a result, as illustrated in FIG. 12, a layer of the resin 3 which embraces the core wire 61 and covers the entire connecting portion 15 is formed. The resin 3 entirely covers the distal end surface 15*c* of the side wall portion 15*b*, and protects the distal end surface 15*c* from being brought into contact with water. As illustrated in FIG. 13, the resin 3 applied by coating to the cover crimping portion 13 forms a layer of the resin 3 which entirely covers an upper surface of the cover crimping portion 13. The resin 3 covers the upper surface of the cover crimping portion 13 from one end to the other end in the second direction W.

As illustrated in FIG. 1, the coating apparatus 70 applies the resin 3 by coating such that the resin 3 integrally covers a portion ranging from the distal end 61*a* of the core wire 61 to the cover crimping portion 13. The coated resin 3 has a first cover portion 30*a*, a second cover portion 30*b*, a third cover portion 30*c*, and a fourth cover portion 30*d*. The first cover portion 30*a* is a portion that integrally covers the intermediate portion 61*b* of the core wire 61 and the distal end surface 15*c* of the connecting portion 15. The first cover portion 30*a* covers a range from one end to the other end of the connecting portion 15 in the second direction W as viewed in a plan view. That is, as viewed in a plan view, the shape of the first cover portion 30*a* is substantially the same as the shape of the connecting portion 15.

The second cover portion 30*b* is a portion that covers the core crimping portion 12. The second cover portion 30*b* covers a range from one end to the other end of the core crimping portion 12 in the second direction W as viewed in a plan view. That is, as viewed in a plan view, the shape of the second cover portion 30*b* is substantially the same as the shape of the core crimping portion 12.

The third cover portion 30*c* is a portion that integrally covers the distal end 61*a* of the core wire 61 and the intermediate portion 14. The third cover portion 30*c* is formed from the end surface 61*c* of the core wire 61 to the terminal connecting portion 11 side, and covers the whole distal end 61*a*. More specifically, the third cover portion 30*c* integrally covers the bottom portion 14*a*, the end surface 14*b*, and the distal end 61*a* of the intermediate portion 14.

The fourth cover portion 30*d* is a portion which covers the cover crimping portion 13. The fourth cover portion 30*d* covers a range from one end to the other end of the cover crimping portion 13 in the second direction W as viewed in a plan view. That is, as viewed in a plan view, the shape of the fourth cover portion 30*d* is substantially the same as the shape of the cover crimping portion 13.

As illustrated in FIG. 1, a coating range of the resin 3 includes the bottom portion 14*a* of the intermediate portion 14, the distal end 61*a* of the core wire 61, the core crimping portion 12, the connecting portion 15, the cover crimping portion 13, and the cover 62 in the first direction L. A coating range of the resin 3 in the second direction W is from one end to the other end of the crimp terminal 1.

When the coating step is completed, a curing step of curing the resin 3 is performed. The curing step may be performed by the coating apparatus 70, or may be performed by an apparatus different from the coating apparatus 70. The curing step of this embodiment is performed in a state where the electric wire with a terminal 2 is held by a pair of pressing portions 72. When the resin 3 is an ultraviolet curable resin, an ultraviolet ray is irradiated to the resin 3 in a curing step. In this embodiment, an ultraviolet ray is irradiated to electric wire with a terminal 2 by an irradiation unit which the coating apparatus 70 has. In the curing step, the resin 3 is fixed to the core wire 61, the cover 62, and the crimp terminal 1 and hence, a resin member which integrally covers the core 61, the cover 62, and the crimp terminal 1 is formed.

When the resin 3 is cured, the coating apparatus 70 releases a holding state brought about by the pair of pressing portions 72, and releases the electric wire with a terminal 2 from the pair of pressing portions 72. More specifically, the holding unit 71 retracts the rods 73*b* of the driving units 73 so as to move two holding surfaces 74*a* away from each other. As a result, a pressing force generated by the pair of pressing portions 72 and pressing the crimp terminal 1 is released and hence, the electric wire with a terminal 2 can be removed.

The resin 3 cured in the curing step has, as illustrated in FIG. 14 to FIG. 16, side surfaces 3B and 3C which correspond to the holding surfaces 74*a*. More specifically, the resin 3 has a top surface 3A, the first side surface 3B, and the second side surface 3C. The first side surface 3B is a side surface which corresponds to the holding surface 74*a* of the first pressing portion 72A. The second side surface 3C is a side surface which corresponds to the holding surface 74*a* of the second pressing portion 72B. The top surface 3A is a surface which corresponds to a liquid surface of the resin 3 stored in the storage portion 4. Surface shapes of the holding surfaces 74*a* are transferred to the first side surface 3B and the second side surface 3C.

As illustrated in FIG. 14, in the core crimping portion 12, the first side surface 3B is continuously formed with an outer side surface 22*e* of the first caulking lug 22. The outer side surface 22*e* is a surface which faces a side opposite to the core wire 61 in the proximal end portion 22*c*. The outer side surface 22*e* extends in the third direction H in cross section orthogonal to the first direction L. For example, the outer side surface 22*e* is disposed orthogonal to the second direction W. The first side surface 3B is continuously smoothly formed with the outer side surface 22*e*, for example. The first side surface 3B extends in the third direction H in cross section orthogonal to the first direction L. For example, the first side surface 3B is disposed orthogonal to the second direction W. In the second cover portion 30*b* of this embodiment, the first side surface 3B and the outer side surface 22*e* of the proximal end portion 22*c* may form one plane.

The second side surface 3C is continuously formed with an outer side surface 23*e* of the second caulking lug 23. The outer side surface 23*e* is a surface which faces a side opposite to the core wire 61 in the proximal end portion 23*c*. The outer side surface 23*e* extends in the third direction H in cross section orthogonal to the first direction L. For example, the outer side surface 23*e* is disposed orthogonal to the second direction W. The second side surface 3C is a surface which is continuously formed with the outer side surface 23*e*. For example, the second side surface 3C is continuously smoothly formed with the outer side surface 23*e*. The second side surface 3C extends in the third direction H in cross section orthogonal to the first direction L. For example, the second side surface 3C is disposed orthogonal to the second direction W. In the second cover portion 30*b* of this embodiment, the second side surface 3C and the outer side surface 23*e* of the proximal end portion 23*c* may form one plane.

As illustrated in FIG. 15, in the connecting portion 15, the first side surface 3B and the second side surface 3C are continuously formed with the outer side surface 15*d* of the side wall portion 15*b*. The outer side surface 15*d* is a surface which faces a side opposite to the core wire 61 in the side wall portion 15*b*. The outer side surface 15*d* extends in the third direction H in cross section orthogonal to the first direction L. For example, the outer side surface 15*d* is disposed orthogonal to the second direction W. The first side surface 3B and the second side surface 3C are, for example, continuously smoothly formed with the outer side surface 15*d*. The first side surface 3B and the outer side surface 15*d* may form one plane, and the second side surface 3C and the outer side surface 15*d* may form one plane. The first side surface 3B and the second side surface 3C extend in the third direction H in cross section orthogonal to the first direction L. For example, the first side surface 3B and the second side surface 3C are disposed orthogonal to the second direction W.

As illustrated in FIG. 16, in the cover crimping portion 13, the first side surface 3B is continuously formed with the outer side surface 32*f* of the first caulking lug 32. The outer side surface 32*f* is a surface which faces a side opposite to the cover 62 in the proximal end portion 32*c*. The second side surface 3C is continuously formed with the outer side surface 33*f* of the second caulking lug 33. The outer side surface 33*f* is a surface which faces a side opposite to the cover 62 in the proximal end portion 33*c*. The outer side surfaces 32*f*, 33*f* extend in the third direction H in cross section orthogonal to the first direction L. For example, the outer side surfaces 32*f*, 33*f* are disposed orthogonal to the second direction W. The first side surface 3B is continuously smoothly formed with the outer side surface 32*f*, for example. The second side surface 3C is continuously smoothly formed with the outer side surface 33*f*, for example. The first side surface 3B and the second side surface 3C extend in the third direction H in cross section orthogonal to the first direction L. For example, the first side surface 3B and the second side surface 3C are disposed orthogonal to the second direction W. The first side surface 3B and the outer side surface 32*f* may form one plane, and the second side surface 3C and the outer side surface 33*f* may form one plane.

As has been described above, the electric wire with a terminal 2 according to this embodiment includes the electric wire 60, the crimp terminal 1, and the resin 3. The electric wire 60 has the core wire 61 and the cover 62 which covers the core wire 61 in a state where the end portion of the core wire 61 is exposed. The crimp terminal 1 has: the core crimping portion 12 which is crimped to the core wire 61; the cover crimping portion 13 which is crimped to the cover 62; and the connecting portion 15 which extends from the core crimping portion 12 to the cover crimping portion 13. The resin 3 integrally covers the core wire 61 and the crimp terminal 1.

The core wire 61 has the intermediate portion 61*b* which extends between the core crimping portion 12 and the cover crimping portion 13. The connecting portion 15 has the bottom wall portion 15*a* and the pair of side wall portions 15*b*. The pair of side wall portions 15*b* extend along the height direction of the crimp terminal 1 from the end portions of the bottom wall portion 15*a* in the width direction.

The resin 3 has the first cover portion 30*a* which integrally covers the distal end surfaces 15*c* of the side wall portions 15*b* and the intermediate portion 61*b*. The first cover portion 30*a* has the side surfaces 3B and 3C on both sides in the width direction. The side surfaces 3B and 3C are continuously formed with the outer side surface 15*d* of the side wall portions 15*b*, and extend along the height direction of the crimp terminal 1. In the electric wire with a terminal 2 according to this embodiment, the whole distal end surfaces 15*c* of the side wall portions 15*b* are covered by the first cover portion 30*a*. Accordingly, it is possible to prevent water from adhering to the distal end surface 15*c* and hence, the corrosion prevention performance of the electric wire with a terminal 2 can be enhanced. The distal end surface 15*c* is a cut surface formed at the time of manufacturing the crimp terminal 1 and hence, plating is not applied to the distal end surface 15*c* in general. According to this embodiment, the distal end surfaces 15*c* are appropriately protected. It is allowable that a portion of the outer side of the distal end surface 15*c* is exposed without being covered by the resin 3. The elastic member 74 is elastically deformed by being pressed toward the connecting portion 15 and hence, there is a possibility that the holding surface 74*a* covers a part of the distal end surface 15*c*. In this case, there is a possibility that the resin 3 is not applied by coating to a portion of the distal end surface 15*c*. However, the resin 3 is applied by coating to the substantially whole area of the distal end surface 15*c* and hence, sufficient corrosion prevention performance can be ensured.

In the electric wire with a terminal 2 of this embodiment, the resin 3 is not applied by coating to the outer side surface 15*d* of the side wall portion 15*b*. Accordingly, compared to the case where the resin 3 is applied to the outer side surface 15*d*, a terminal width at the connecting portion 15 can be reduced. Further, compared to the case where the resin 3 is applied by coating to the outer side surface 15*d*, irregularities in terminal width minimally occurs at the connecting portion 15.

The coating apparatus 70 according to this embodiment has the holding unit 71 and the coating unit 76. The holding unit 71 holds the connecting portion 15 of the electric wire with a terminal 2 extending from the core crimping portion 12 to the cover crimping portion 13. The coating unit 76 applies the resin 3 to the connecting portion 15 held by the holding unit 71, and integrally covers the connecting portion 15 and the core wire 61 of the electric wire 60 by the resin 3.

The holding unit 71 has a pair of pressing portions 72 having a plate shape. The pair of pressing portions 72 hold the connecting portion 15 from both sides in the width direction by being brought into contact with the outer side surfaces 15*d* of the pair of side wall portions 15*b* which the connecting portion 15 has. By applying the resin 3 by coating in a state where the connecting portion 15 is held by the pair of pressing portions 72, it is possible to apply the resin 3 by coating to the distal end surfaces 15*c* without causing the adhesion of the resin 3 on the outer side surfaces 15*d* of the side wall portions 15*b*. Accordingly, the coating apparatus 70 of this embodiment can enhance the corrosion prevention performance of the electric wire with a terminal 2 while suppressing the increase of the terminal width.

The method of manufacturing an electric wire with a terminal according to this embodiment includes a holding step and a coating step. The holding step is a step of holding the connecting portion 15 extending from the core crimping portion 12 to the cover crimping portion 13 in the electric wire with a terminal 2 by the pair of pressing portions 72 having a plate shape from both sides in a width direction. The coating step is a step of applying a resin to the connecting portion 15 held by the pair of pressing portions 72. In the coating step, the distal end surfaces 15*c* of the pair of side wall portions 15*b* which the connecting portion 15 has and the core wire 61 of the electric wire 60 are integrally covered by the resin 3. According to the method of manufacturing an electric wire with a terminal of this embodiment, the corrosion prevention performance of the electric wire with a terminal 2 can be enhanced while suppressing the increase of the terminal width.

Modifications of Embodiment

Modifications of the embodiment are described. The cross-sectional shape of the resin 3 is not limited to the shapes illustrated in FIG. 14 to FIG. 16. Cross-sectional shape of the resin 3 is formed in conformity with the shape of the holding surfaces 74*a* when the resin 3 is applied by coating. The first side surface 3B and the second side surface 3C may be inclined with respect to the third direction H. Cross-sectional shapes of the first side surface 3B and the second side surface 3C may not be a straight line shape, and for example, may be a shape having a curved portion.

In the electric wire with a terminal 2, the range where the resin 3 is applied by coating is not limited to the range exemplified in the above-mentioned embodiment. For example, with respect to the second cover portion 30*b*, it is sufficient that the second cover portion 30*b* covers at least the groove portion 24 of the core crimping portion 12. In this case, the second cover portion 30*b* may have neither the first side surface 3B nor the second side surface 3C. For example, it is sufficient that the fourth cover portion 30*d* covers at least the groove portion 34 of the cover crimping portion 13. In this case, the fourth cover portion 30*d* may have neither the first side surface 3B nor the second side surface 3C.

The resin 3 may not have at least one of the second cover portion 30*b*, the third cover portion 30*c*, and the fourth cover portion 30*d*. As an example, the resin 3 may be formed of the first cover portion 30*a*, the second cover portion 30*b*, and the third cover portion 30*c*, and may not have the fourth cover portion 30*d*.

The range where the pair of pressing portions 72 hold the crimp terminal 1 is not limited to the range exemplified in the above-mentioned embodiment. For example, the pair of pressing portions 72 may hold the connecting portion 15, and may not hold the core crimping portion 12 and the cover crimping portion 13. For example, the pair of pressing portions 72 may hold the intermediate portion 14, the core crimping portion 12, and the connecting portion 15, and may not hold the cover crimping portion 13.

A crimped shape of the core crimping portion 12 and the cover crimping portion 13 is not limited to the shapes exemplified in the above-mentioned embodiment. For example, the cover crimping portion 13 may be wrapped on the cover 62 by overlapping the first caulking lug 32 and the second caulking lug 33 each other.

The contents disclosed in the above-mentioned embodiments and modifications can be carried out in suitable combinations.

In the electric wire with a terminal according to the embodiment, the resin has a first cover portion which integrally covers the distal end surfaces of the side wall portions and an intermediate portion of the core wire, the first cover portion has side surfaces on both sides in a width direction which are disposed continuously with outer side surfaces of the side wall portions and extend along a height direction of the crimp terminal. According to the electric wire with a terminal of the embodiment, a width of the connecting portion can be minimized while allowing the connecting portion to cover the whole distal end surfaces of the side wall portions. Accordingly, the electric wire with a terminal can acquire both the reduction of a terminal width and enhancement of corrosion prevention performance.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A method of manufacturing an electric wire with a terminal comprising:

a holding step of holding a connecting portion that extends from a core crimping portion to a cover crimping portion of the electric wire with a terminal by a pair of pressing portions having a plate shape from both sides in a width direction; and a coating step of applying a resin to the connecting portion that is held by the pair of pressing portions such that distal end surfaces of a pair of side wall portions that the connecting portion has and a core wire of an electric wire are integrally covered by the resin.

2. The method of manufacturing an electric wire with a terminal according to claim 1, further comprising:

a curing step of curing the resin by irradiating an ultraviolet ray to the resin, and a releasing step of releasing the resin cured in the curing step and the electric wire with a terminal from the pair of pressing portions by moving the pair of pressing portions away from each other.

* * * * *